United States Patent [19]

Corley

[11] Patent Number: 4,943,055

[45] Date of Patent: Jul. 24, 1990

[54] WEIGHTED WARMUP BALL

[76] Inventor: Deryl Corley, 7108 Carolenna Ct., North Richland Hills, Tex. 76180

[21] Appl. No.: 384,328

[22] Filed: Jul. 24, 1989

[51] Int. Cl.[5] ..... A63B 69/40

[52] U.S. Cl. ..... 273/26 R; 273/60 R; 273/DIG. 20

[58] Field of Search ..... 273/26 R, 60 R, 60 A, 273/60 B, DIG. 20, 58 A, 58 B, 58 BA, 58 J, 59 B

[56] References Cited

U.S. PATENT DOCUMENTS

| | | | |
|---|---|---|---|
| 1,568,514 | 1/1926 | Lewis | 273/DIG. 20 |
| 3,908,993 | 9/1975 | Gentiluomo | 273/60 R |
| 3,942,793 | 3/1976 | Lombardo | 273/60 R |

*Primary Examiner*—George J. Marlo

*Attorney, Agent, or Firm*—Johnson & Gibbs

[57] ABSTRACT

A weighted ball includes essentially only a metal center core, an outer cover, and an intermediate material disposed between the metal center core and the outer cover. A small amount of silicone rubber or a similar material may surround the metal center core for adhesively bonding the core to the intermediate material. In all respects to a user, other than weight, a weighted warmup ball is identical to a regulation ball of some kind, e.g., a softball; thus, a weighted ball according to the present invention is an ideal warmup device. Yet another novel aspect of the aspect of the present invention relates to the placement of indicia on the outer cover of a warmup ball according to the present invention which indicia are related to weight and/or added relate on some similar aspect of the ball. Still further, a set of weighted balls according to the present invention, which balls having varying weights, provides an ideal means by which a person desiring to warm up can select a warm-up ball most useful to him or her based upon his or her strength or other factors.

13 Claims, 1 Drawing Sheet

WEIGHTED WARMUP BALL

BACKGROUND OF THE INVENTION

1. Field of the Invention

This invention relates to balls commonly used in sporting events and, more particularly, to such balls into which metal cores have been incorporated.

2. Description of Related Art

In certain sports, such as baseball and softball, it is desirable for athletes to be able to throw a ball so that it travels a long distance at a high speed and so that it arrives at a precise location. That is, the distance, accuracy and speed with which a player can throw a ball are important skills.

Recognizing the foregoing, many players undertake certain activities to improve their throwing skills. These activities include warming up, exercising and practicing. Warmup activities are those designed to ready a person's muscles for upcoming, more strenuous activities. Exercise encompasses all of those activities undertaken to strengthen or hone the muscles that are employed in motions commonly executed in a particular sport. Practice refers to activities undertaken directly to improve an athlete's skill in a particular sport or event. Some activities fall into more than one of the categories set forth above.

Regulation equipment is frequently used in warmup and practice activities. For example, a softball pitcher may softly throw a number of pitches with a regulation ball in order to warm up. Regulation equipment is frequently used in practice or "scrimmage" games. Regulation equipment is somewhat less frequently used for exercise purposes.

Of course, there is no requirement that regulation equipment be employed in warmup, exercise and practice activities. In fact, certain benefits based upon the use of special equipment for warmup, exercise and practice activities have long been appreciated. Such special equipment may serve a variety of functions, such as protecting athletes from injury during non-game situations, eliminating the necessity of players performing certain functions (e.g., a pitching machine being used rather than a pitcher), and enhancing the benefit of actions undertaken by a training athlete.

A common tool used to enhance the benefits of actions undertaken by athletes is a weight. The exercise benefits of lifting and training with weights are well known. Muscles that manipulate weights strengthen. Additionally, weights are recognized as being valuable in warming up. For example, weighted bats are used by batters to warmm up. A example of such a bat may be seen in U.S. Pat. No. 3,116,926 to Owen. Use of donut-shaped weights in connection with a bat so as to form a relatively heavy bat for warmup swinging purposes are also known. Additionally, weighted balls such as the weighted baseball disclosed in U.S. Pat. No. 3,942,793 to Lombardo and the weighted football disclosed in U.S. Pat. No. 1,597,308 to Brandt have heretofore been developed.

Notwithstanding the widely recognized benefits of such weighted balls, heretofore no one has disclosed or suggested a simple, easily manufactured, easy-to-use weighted ball. This is particularly surprising in view of the rapidly increasing popularity of certain sports involving balls. Softball, in particular, has become extremely popular. Countless softball teams have been formed in the United States and abroad during the past several years. Special balls have been developed based upon whether fast pitch or slow pitch softball is to be played or whether men or women are playing. Notwithstanding the fact that special softballs have been developed for, e.g., fast pitch, slow pitch, and women's softball, heretofore no one has conceived of or reduced to practice a weighted softball especially suitable for use in warming up.

SUMMARY OF THE INVENTION

To overcome the shortcomings of the prior art and to provide a simple, easily manufactured and easy-to-use weighted ball, the presennt invention broadly teaches a ball including a metal center core, an outer cover, and packing or filler intermeiate material disposed between the metal center core and the outer cover.

In certain embodiments of the present invention, the ball is regulation softball size and the metal center core weighs from about 2 ounces to about 12 ounces.

The present invention also includes teachings relating to placing indicia on the outer cover of the ball, which indicia are related to the weight of the ball.

Stated another way, according to the broad teachings of the present invention, a ball includes a purely metallic center core, an outer cover and an intermediate material disposed between, and adjacent to, the purely metallic center core and the outer cover, the intermediate material having a relatively dense, packing or filler configuration.

Certain embodiments of the present invention may include a thin layer of material disposed between the purely metallic center core and the intermediate material. This thin layer of material may have adhesive qualities and/or may be operable to keep the purely metallic center core centrally positioned and/or may have bonding capabilities. Silicon, having all of the aforementioned qualities and/or effects, is an excellent thin layer material.

The present invention is also directed to a set of balls including at least two balls, each having a metal center core, an outer cover, and a packing or filler material disposed immediately around the metal center core and between the metal center core and the outer cover.

In certain embodiments of the present invention, each of the balls may further include indicia on the outer covers thereof, such indicia relate to the weight of each ball.

The indicia may specifically indicate relative weight of all of the balls in the set of balls.

In a preferred embodiment of the present invention, there are three balls, one ball being relatively light, one being relatively heavy, and one ball having a weight intermediate between the weight of the relatively light ball and the relatively heavy ball.

Accordingly, it is an object of the present invention to provide a ball especially suitable for use in warming up, thus reducing the likelihood of muscle soreness.

It is another object of the present invention to provide a ball that effectively exercises and strengthens the muscles in a ball player's throwing arm.

It is yet another object of the present invention to provide a ball that acclimates a person to handling a ball of relatively heavy weight, thereby causing that person to instinctly exert more force on a regulation ball, that then seems relatively light, causing that ball to be thrown farther and faster.

Still yet another object of the present invention is to provide a weighted warmup ball that can be easily and less expensively manufactured that prior art weighted balls.

A further object of the present invention is to provide a weighted warmup ball that can be easily distinguished from a regulation ball despite its regulation size.

Yet another object of the present invention is to provide a warmup ball that is long lasting.

Still yet a further object of the present invention is to provide a set of weighted warmup balls according to the present invention, each of which balls in the set has indicia thereon indicative of the weight of each ball relative to the weight of each of the other balls in the set.

Yet another object of the present invention is to provide a set of balls of graduated weights, thereby allowing a user of the set to select a weighted ball most suitable for his or her purposes and/or desires.

BRIEF DESCRIPTION OF THE DRAWING

For a more complete understanding of the present invention, and for further objects and advantages thereof, reference may now be had to the following description taken in conjunction with the accompanying drawings in which.

DETAILED DESCRIPTION OF ONE INVENTION

Figure 1:
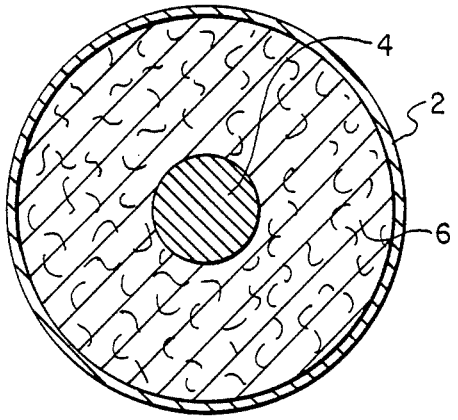
FIG. 1 is a cross-sectional view of a first embodiment of the present invention.

Referring now to the drawings wherein like reference numerals designate the same or similar elements throughout the several views, FIG. 1 is a cross-sectional view of a weighted warmup ball according to the teachings of the present invention. Very broadly, a warmup ball according to the present invention consists of an outer cover 2, an inner core 4, and an intermediate material 6.

Outer cover 2 is a conventional outer cover for a regulation ball, that is, a baseball, a softball, or the like. Being a conventional cover, it is of regulation size, formed of regulation material, of regulation cut, and stitched in a regulation manner using regulation thread. Details regarding what is regulation may vary depending upon the type of ball and are relatively unimportant herein as those details do not constitute inventive aspects of the present invention and are well known to those skilled in the art. It is, however, very important with respect to the present invention that a ball according to the present invention feel identical to a regulation ball in every respect except with regard to weight. Thus, the materials used on the outer cover and the size of the outer cover should be virtually identical to, if not exactly the same as, a regulation ball so that it imparts the proper feel.

Centrally positioned within said outer cover 2 is an inner core 4. Core 4 must effectively insure that a warmup ball according to the present invention exceeds the weight of a regulation ball. Core 4 must also not be so large so as to not be coverable by outer cover 2. Within those broad guidelines, great latitude in the composition and size of core 4 is possible. Generally, however, it minimizes expense and potential manufacturing difficulties if inner core 4 is formed of a single material, and if inner core 4 is fairly small. Based on the foregoing, metals are ideal for forming inner core 4 because of their relatively high weight per size, i.e., high density. In a preferred embodiment of the present invention, a steel ball bearing could be inner core 4 because such ball bearings are inexpensive, easy to come by, and because they possess all of the desired characteristics of inner core 4 discussed above. Steel ball bearings are also especially suitable for use as inner core 4 because they come in a number of common varying weights, the benefits of which will be discussed further below.

As discussed above, disposed between outer cover 2 and inner core 4 is an intermediate material 6. In the present invention, intermediate material 6 comprises a packing or filler material. This packing or filler material may comprise kapok, cork, a cork and rubber mixture, a polymer, polyurethane, a combination of any of the foregoing, or any materials similar to any of the foregoing. There are several reasons for this. First, virtually all conventional softballs and the like have such a material disposed within them; thus, including such material in a warmup ball according to the present invention helps ensure that the ball has the proper feel. Second, such a material may be prepared or treated so as to have a predetermined, desired density. Thus, it is relatively easy to adjust the amount of material included in a warmup ball according to the present invention so that the inner core 4 is effectively held in position by inherent operation of the intermediate material 6 and so that the overall warmup ball has the same feeling of relative hardness as does a regulation ball. In this regard it is important to note that the intermediate material 6 does not comprise rubber coatings or hemispheres as in Lombardo, so that simplicity and ease of manufacture are enhanced, and so that unnecessary and/or inappropriate materials are not included in certain balls.

Figure 2:
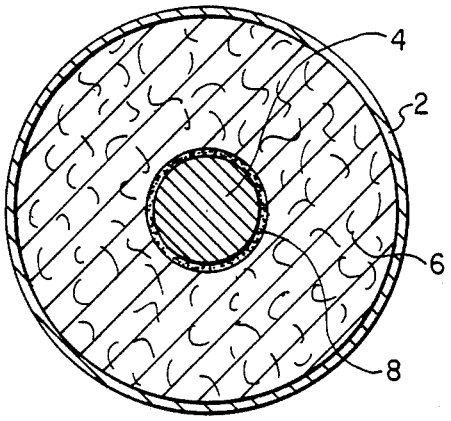
FIG. 2 is a cross-sectional view of an alternatve embodiment of the present invention.

Referring now to FIG. 2, an alternative embodiment of a weighted warmup ball according to the present invention is shown therein. This embodiment differs from the embodiment of FIG. 1 by including a layer of material 8 between the inner core and the intermediate material. In most emboiments of the present invention, this layer of material will be thin. This material may serve one or more of a number of purposes. First, it may rigidify the intermediate material 6 in the immediate vicinity of the inner core. Performing such a function, it should be readily apparrent that such a thin layer 8 will thereby operate to keep the inner core in place, which is very inportant with respect to weighted warmup ball quality and durability. Secondly, the thin layer 8 may have attachment properties, that is, it may operate to bind or connect the inner core 4 and those portions of the intermediate material 6 touching or proximity to the inner core 4. For this second function, as well as the first, any number of conventional materials having adhesive and/or bonding properties would form a suitable thin layer 8. Glue would be one example of a suitable thin layer material. Silicone rubber would be another such example. There are, of course, a number of other suitable materials.

At this point, it is appropriate to discuss a particular, preferred embodiment of the present invention. This preferred embodiment relates to a conventional, regulation softball. In such an embodiment, the outer layer would be a conventional softball cover, formed of regulation materials in a regulation manner. Likewise, the intermediate material 6 would also be the conventional packing or filler material presently disposed in regulation softballs. This material can be formed and/or solidified in a mold by techniques well known to those skilled in the softball manufacturing art so that, based upon certain factors discussed further below, the final weighted warmup ball produced has the same hardness and feel (other than with respect to weight) of a regulation ball.

The certain factors alluded to above arise because a warmup softbal according to the present invention has a metal central core 4 rather than a packing or filler core as do conventional softballs. The purpose of including such a metal core 4 in a ball is purely to increase the weight of the ball. As metals are generally much heavier than typical packing or filler materials included in softballs and the like per unit size, placing a heavy metal ball, such as a steel ball bearing, in the center of the ball will inevitably result in a ball of increased weight. Still, packing or filler material may be disposed around the metal core with a consistenancy that ensures a modified, weighted ball has a proper feel with respect to relative hardness.

The inventor of the present invention has experimented and found that 3 ounce, 5 ounce and 7 ounce steel ball bearings (all of which are readily available) are especially effective in warmup balls according to the present invention. Other weights are possible and may even be desirable. Virtually any weight from a fraction of an ounce to just below the weight of a steel ball bearing the size of a conventional softball may be used. The inventor of the present invention has found that inner core weights ranging from about 2 ounces to about 12 ounces are very suitable.

Depending upon the final density of the intermediate material 6, a softball according to the present invention may or may not include a thin layer 8 as discussed above. If the final density of the intermediate material 6 is low, a thin layer will probably be advisable to keep the inner core in place. If the final density of intermediate material 6 is high, a thin layer 8 is probably not necessary.

Figure 3:
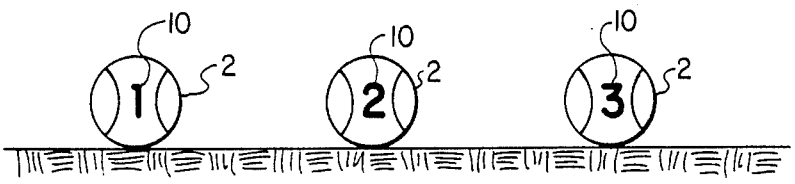
FIG. 3 is a view of a set of balls as in FIGS. 1 or 2, showing indicia on the outer covers of said balls.

Referring now to FIG. 3, another important aspect of the present invention and an alternative preferred embodiment is shown therein. The important aspect relates to the fact that a weighted warmup ball according to the present invention has indicia 10 on the outer cover 2 of the ball, which indicia are related to the ball's weight. These indicia 10 serve to inform a ball user of exactly what he or she is using and it also serves to distinguish a warmup ball according to the present invention from a conventional, regulation ball.

As mentioned above, FIG. 3 also shows an alternative preferrd embodiment of the present invention. This alternative preferred embodiment comprises a set of weighted warmup balls, of varying weights, so that a person may select a ball most suitable for his or her purposes. In such a case, it is very useful if the indicia 10 on the outside of the balls relates to relative weights of the balls in the set, e.g., light, medium and heavy. The indicia 10, or perhaps even the entire outer cover 2, may be color coded so as to facilitate this distinguishment function.

With respect to manufacture of a warmup ball according to the present invention, manufacture will be essentially conventional, except that, as with the softball embodiment described above, a metal core, will be centrally positioned prior to intermediate material formation.

Operation and use of a warmup ball should be readily apparent to those skilled in the art. Such a ball can be used to loosen muscles for flexibility in immediately following, more strenuous activity. Heavy weighted balls may share an exercising function, that is, strengthening muscles. Yet an additional benefit of the present invention is that practice with the weighted warmup ball conditions a player's muscles to exert a certain force upon a regulation-sized, but above regulation-weight ball to obtain a certain effect. As a warmup ball according to the present invention weighs more than a regulation ball, a stronger force must be exerted on it to obtain a desired effect. Consequently, when a completely regulation ball is handled subsequent to a player's conditioning with a weighted warmup ball, the completely regulation ball will seem light and when the same force is exerted on it due to the player's conditioning with the weighted warmup ball, the completely regulation ball will be thrown farther and faster.

Obviously, numerous modifications and variations are possible in view of the above teachings. Accordingly, within the scope of the appended claims the present invention may be practiced other than as specifically described herein.

I claim:

1. A ball comprising:

a metal center core;

an outer cover;

an intermediate material disposed between said metal center core and said outer core, said intermediate material consisting of packing or filler material; and means for adhesively bonding said core to said packing or filling material for keeping said core in place within said packing or filling material.

2. A ball as recited in claim 1, wherein said ball is regulation softball size and wherein said metal center core weighs from about 2 ounces to about 12 ounces.

3. A ball as recited in claim 1, wherein said outer cover has indicia thereon for indicating the relative weight of said ball.

4. A ball comprising:

a purely metallic center core;

an outer cover;

an intermediate material disposed between and adjacent to said purely metallic center core and said outer cover, said intermediate material consisting of packing or filler material; and means for adhesively bonding said core to said packing or filling material for keeping said core in place within said packing or filling material.

5. A ball as recited in claim 4, wherein said adhesive means defines a layer of material disposed between said purely metallic center core and said intermediate material.

6. A ball as recited in claim 5, wherein said layer is thin.

7. A ball as recited in claim 6, wherein said thin layer of material consists of silicone rubber.

8. A ball as recited in claim 4, wherein said purely metallic center core weighs less than one pound.

9. A ball as recited in claim 4, wherein said outer cover has indicia thereon for indicating the relative weight of said ball.

10. A set of balls comprising at least two balls each comprising a metal center core;

an outer cover;

a packing or filler material disposed immediately around said metal center core and between said metal center core and said outer cover; and means for adhesively bonding said core to said packing or filling material for keeping said core in place within said packing or filling material.

11. A set of balls as recited in claim 13, wherein each of said balls further comprise indicia on the outer covers thereof for indicating the relative weights thereof.

12. A set of balls as recited in claim 11, comprising three balls, one ball being relatively light, one being relatively heavy, and one having a weight intermediate between the weight of said relatively light ball and said relatively heavy ball.

13. A set of balls as recited in claim 11, wherein the indicia on each ball is a different color.

* * * * *

UNITED STATES PATENT AND TRADEMARK OFFICE

CERTIFICATE OF CORRECTION

PATENT NO. : 4,943,055

DATED : July 24, 1990

INVENTOR(S) : Deryl Corley

It is certified that error appears in the above-identified patent and that said Letters Patent is hereby corrected as shown below:

| | |
|---|---|
| Column 1, line 52 | delete"warmm"<br>insert --warm-- |
| Column 2, line 14 | delete "presennt"<br>insert --present-- |
| Column 2, line 16 | delete "intermeiate"<br>insert --intermediate-- |
| Column 3, line 29 | delete "alternatve"<br>insert --alternative-- |
| Column 4, line 44 | delete "emboiments"<br>insert --embodiments-- |
| Column 4, line 49 | delete "apparrent"<br>insert --apparent-- |
| Column 4, line 51 | delete "inportant"<br>insert --important-- |
| Column 5, line 11 | delete "softbal"<br>insert --softball-- |
| Column 5, line 55 | delete "preferrd"<br>insert --preferred-- |
| Column 6, line 32 | delete "outer core"<br>insert --outer cover-- |

UNITED STATES PATENT AND TRADEMARK OFFICE

CERTIFICATE OF CORRECTION

PATENT NO. : 4,943,055

DATED : July 24, 1990

INVENTOR(S) : Deryl Corley

It is certified that error appears in the above-identified patent and that said Letters Patent is hereby corrected as shown below:

Column 8, line 1 delete "13"
insert --10--

Signed and Sealed this

First Day of October, 1991

*Attest:*

*Attesting Officer*

HARRY F. MANBECK, JR.

*Commissioner of Patents and Trademarks*